United States Patent [19]

Ash

[11] 4,194,689

[45] Mar. 25, 1980

[54] METHOD AND APPARATUS FOR MAKING SNOW

[76] Inventor: Robert M. Ash, P.O. Box 277, Banner Elk, N.C. 28604

[21] Appl. No.: 943,808

[22] Filed: Sep. 19, 1978

[51] Int. Cl.[2] ..... A01G 15/00; E01H 13/00

[52] U.S. Cl. ..... 239/2 S; 239/14

[58] Field of Search ..... 239/2 S, 14, 434; 62/74

[56] References Cited

U.S. PATENT DOCUMENTS

| | | | |
|---|---|---|---|
| 3,829,013 | 8/1974 | Rutnik | 239/14 |
| 3,897,904 | 8/1975 | Kiegerl | 239/2 S |

*Primary Examiner*—Richard A. Schacher

*Attorney, Agent, or Firm*—Woodford R. Thompson, Jr.

[57] ABSTRACT

A method and apparatus for producing snow which embodies an inner tubular housing mounted within and spaced from a closed outer tubular housing defining a passageway therebetween for receiving air under pressure. Water under pressure is supplied to the inner tubular housing. Longitudinally spaced discharge orifices are provided in a side of the outer tubular housing and the adjacent side of the inner tubular housing with each orifice in the inner tubular housing being in alignment with an adjacent orifice in the outer tubular housing and aiming the stream of water ejected from the inner tubular housing toward the center of the adjacent orifice in the outer tubular housing and into a column of air as the stream of water passes through the adjacent orifice in the outer tubular housing.

11 Claims, 3 Drawing Figures

FIG. 1
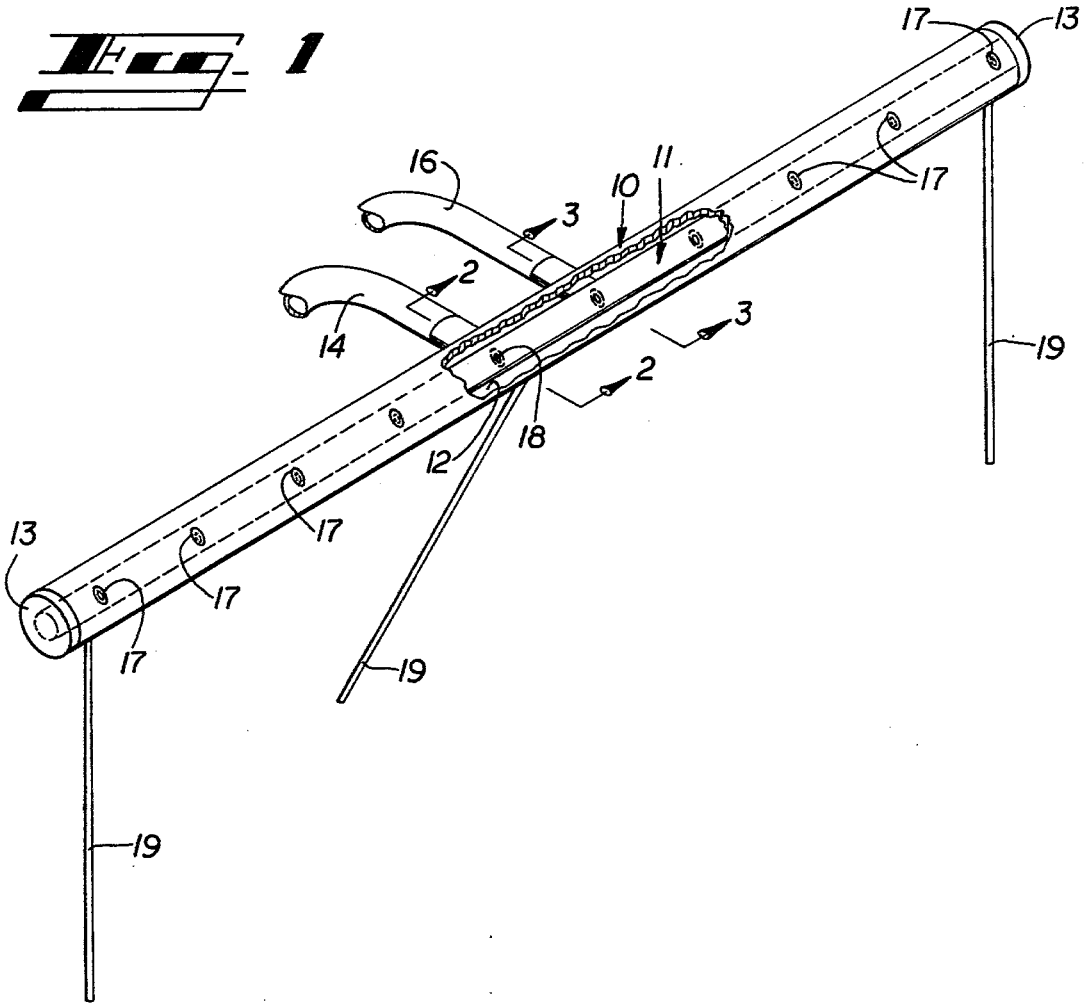
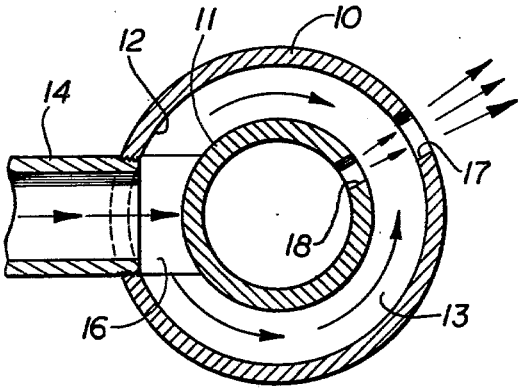
FIG. 2
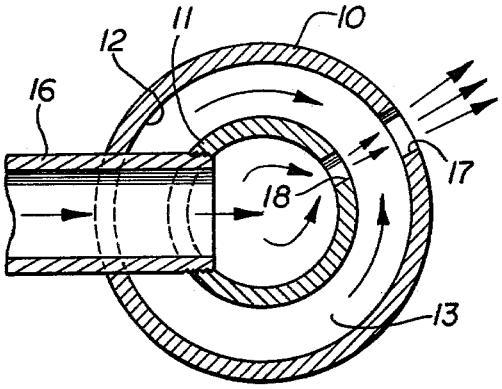
FIG. 3

METHOD AND APPARATUS FOR MAKING SNOW

BACKGROUND OF THE INVENTION

This invention relates to a method and apparatus for making snow and more particularly to such method and apparatus which is adapted for making snow for ski areas and the like.

As is well known in the art to which my invention relates, many devices have been proposed for making snow. One type of conventional snow gun employs a blower fan and water spray nozzle system wherein the fan moves ambient cold air into a column into which water droplets are introduced by a nozzle system. The water thus freezes to produce snow. One major disadvantage in this type apparatus is that its ability to make snow is very poor when the ambient temperature rises above 27° F. Another well known type of snow gun uses compressed air and water wherein the compressed air plays a major role in atomizing the water to droplets which then freeze in the ambient cold air to produce snow. While the air and water mixture can be accomplished exterior of the gun or internally, most conventional snow guns used today mix air and water internally and then spray the same into the atmosphere. As is well known, conventional snow guns employing compressed cooled air can make more snow under marginal ambient temperatures due to the fact that the expanding air imparts an additional cooling effect. While the air and water can be introduced into snow guns heretofore employed in various ways, the atomization of the water occurs at the nozzle of the snow gun. Accordingly, the effectiveness of such a snow gun is dependent upon the type and design of the nozzle or series of nozzles and manifolds employed in the system. As far as I am aware, all conventional, internal mixed snow guns employed at this time operate on the principle that at the orifice of the nozzle or nozzles a column of air at the center of the discharge orifice forces, pulls or draws the water around the column of air whereby the water is atomized. That is to say, the water surrounds the centrally disposed column of air. Accordingly, the larger the orifice of the nozzle the greater the amount of air used for a given air pressure. The larger orifices thus required for such apparatus make more noise and require more compressor capacity to supply compressed air. Of the two main components employed, air and water, air is the most costly due to the fact that the cost of air compressors is much greater than the cost of water pumps. The cost of operation of air compressors is also much greater than the cost of operating water pumps.

Heretofore, most producers of snow guns have strived to make guns which produce more snow under all conditions; produce more snow especially under marginal conditions (32° F.–27° F.); produce snow more economically; produce snow with less noise; and, disperse the snow over a large area.

SUMMARY OF THE INVENTION

In accordance with my invention, I provide a method and apparatus for producing snow wherein large quantities of water are converted into snow wherein the air to water ratio is at a minimum and at the same time the apparatus is not noisy.

Another object of my invention is to provide apparatus for producing snow which is simple of construction, economical of manufacture and one which disperses the snow uniformly over a large area due to its increased or longer trajectory or throw.

I overcome the above mentioned difficulties and achieve the above mentioned objects of this invention by providing an improved method and apparatus for producing snow wherein water under pressure is introduced into a closed inner tubular housing mounted within and spaced from a closed outer tubular housing having longitudinally spaced discharge orifices in a side thereof. Air under pressure is introduced between the inner tubular housing and the outer tubular housing with the air flowing in generally parallel columns through the discharge orifices. The water from the inner tubular housing is discharged into the axial center of each column of air flowing through each of the discharge orifices so that the water and air passing through and discharged from the orifices travel in the same direction and at the same time the flow of air therethrough is retarded to greatly reduce the volume of air per volume of water passing through the discharge orifice.

DESCRIPTION OF THE DRAWING

Apparatus for making snow and which may be employed for carrying out my improved process is illustrated in the accompanying drawing, forming a part of this application, in which:

FIG. 1 is a perspective view, partly broken away and in section, showing my improved apparatus;

FIG. 2 is an enlarged, sectional view taken generally along the line 2—2 of FIG. 1; and, FIG. 3 is an enlarged, sectional view taken generally along the line 3—3 of FIG. 1.

DETAILED DESCRIPTION

Referring now to the drawing for a better understanding of my invention, I show a closed outer tubular housing 10. Mounted within and spaced from the inner surface of the outer tubular housing 10 is a closed, inner tubular housing 11 which defines a passageway 12 therebetween. The ends of the tubular housings 10 and 11 are closed by suitable means, such as by providing end caps or closure members 13 at opposite ends of the tubular housings 10 and 11. Preferably, the tubular housings 10 and 11 are formed of elongated sections of pipes which are concentrically mounted relative to each other, as clearly shown in FIGS. 2 and 3, to provide an elongated passageway 12 which is annular in shape, as viewed in cross section.

Air under pressure is supplied to the passageway 12 by a conduit 14 which is operatively connected to a suitable source of compressed air, such as a compressor or the like. In view of the fact that such apparatus for supplying compressed air is well known in the art to which my invention relates, no further description thereof is deemed necessary.

Communicating with the inner tubular housing 11, as clearly shown in FIG. 3, is a water supply conduit 16 which supplies water under pressure from a suitable source of supply to the closed inner tubular housing 11.

As clearly shown in FIGS. 2 and 3, longitudinally spaced discharge orifices 17 are provided in a side of the outer tubular housing 10. Also, longitudinally spaced discharge orifices 18 are provided in the side of the inner tubular housing 11 nearest the orifices 17 with each discharge orifice 18 being in position to aim a stream of water ejected therefrom toward the center of the adjacent discharge orifice 17 in the outer tubular housing 10. Accordingly, the stream of water is injected axially into a column of air as the stream of water passes through the adjacent orifice 17 to thereby mix the water and air.

As shown in FIGS. 2 and 3, each orifice 18 in the inner tubular housing 11 is smaller than the adjacent orifice 17 in the outer tubular housing 10 whereby the stream of water ejected from the orifice 18 is surrounded by air as it reaches the adjacent orifice 17, as shown. Since the stream of water ejected from the orifice 18 toward the center of the orifice 17 is surrounded by air as it reaches the orifice 17, the flow of air through the orifice 17 is retarded, thereby reducing the volume of air per volume of water passing therethrough and at the same time both the air and the water are discharged in the same general direction. As shown in the drawing, all of the orifices 17 and 18 are aligned in the same direction whereby adjacent columns of atomized water discharged from adjacent orifices 17 move in a direction generally parallel to each other to thus greatly increase the length of the trajectory or the distance the snow is dispersed from the apparatus. This series of adjacent parallel columns of atomized water causes the ambient air adjacent thereto to tend to flow in the same direction thus reducing the ambient air resistance against the column and further increasing the trajectory of the column of finely atomized water. This longer trajectory provides a desirable long dispersement of snow and at the same time the individual water droplets are exposed to the air for a longer period of time which provides a longer period of time for the water to freeze and greatly increases the amount of good quality snow that can be made under a given atmospheric condition.

The number of orifices 17 and 18 in my improved apparatus may be varied. In actual practice, I have found that the apparatus is more effective where ten or more orifices are provided. Also, the size of the orifices 17 and 18 can be varied so long as the orifice 17 in the outer tubular housing 10 is large enough to accommodate the entire stream of water ejected from the adjacent orifice 18 in the inner tubular housing 11. For example, I have found that my apparatus operates satisfactory in every respect where the orifice 18 in the inner tubular housing 11 is approximately 3/16ths inch in diameter and each of the orifices 17 in the outer tubular housing 10 is approximately 5/16ths inch in diameter. For these orifice sizes, the distance between the discharge orifices may range from six inches to nine inches. However, if larger orifices 17 are employed, the distance between orifices can be increased up to twelve inches. Where the orifice 18 is approximately 3/16ths inch and the orifice 17 is approximately 5/16ths inch, the inner tubular housing may be formed of a pipe-like member of approximately one inch inside diameter while the outer tubular housing may be formed of a pipe-like member having an inner diameter of approximately two inches. In actual practice I have found that by making the gun of these specifications, the pressure of the air entering the conduit 14 may range from approximately 70 to 120 pounds per square inch while the water pressure entering the conduit 16 may vary from 150 to 650 pounds per square inch.

My improved apparatus may be supported by suitable support members, such as by providing depending leg members 19 which position the inner and outer tubular housings 11 and 10, respectively, as shown, whereby the water ejected from the orifice 18 and the water and air passing through the orifice 17 are directed in an upward and outward direction, whereby a maximum trajectory is obtained. The apparatus may also be mounted on towers, poles or the like to give further throw. Such mountings could be articulated in either/or both horizontal and vertical planes to further assist in snow distribution.

From the foregoing, the description of my apparatus and the operation of my improved method will be readily understood. Air under pressure and water under pressure are both introduced continuously and concomitantly through the inlet conduits 14 and 16, respectively, whereby the water is ejected from the orifice 18 into the center of the column of air moving into and through the orifice 17. That is, each orifice 18 in the inner tubular housing 11 is aligned with the orifice 17 in the outer tubular housing 10 whereby the water stream is aimed directly at the center of the orifice 17. Since the orifice 18 in the inner tubular housing 11 is smaller than the orifice 17 in the outer tubular housing 10 the stream of water ejected from the orifice 18 is surrounded by air as the water stream reaches the orifice 17. Accordingly, the expanded air escaping from the orifice 17 in this manner produces an extremely efficient atomization of the water. It should be noted that although the atomization is extremely effficient, my improved apparatus actually uses a substantially less volume of air per volume of water due to the fact that the water is introduced into the center of the air orifice 17 which greatly retards the flow of air therethrough.

From the foregoing, it will be seen that I have devised an improved process and method of converting large quantities of water into snow wherein a minimum air to water ratio is required. Also, by reducing the air to water ratio, my improved apparatus is much quieter in operation. Also, my improved apparatus is adapted to disperse the snow over a large area due to its increased trajectory or throw. Furthermore, by constructing my improved apparatus of concentrically mounted inner and outer tubular housings, my improved apparatus is extremely simple of construction and may be maintained in satisfactory operating condition with a minimum of maintenance.

While I have shown my invention in but one form, it will be obvious to those skilled in the art that it is not so limited, but is susceptible of various changes and modifications without departing from the spirit thereof.

What I claim is:

1. Apparatus for making snow comprising:

(a) a closed outer tubular housing, (b) a closed inner tubular housing mounted within and spaced from the inner surface of said outer tubular housing and defining a passageway therebetween, (c) means supplying air under pressure to said passageway between said outer tubular housing and said inner tubular housing, (d) means supplying water under pressure to said inner tubular housing, (e) longitudinally spaced discharge orifices in a side of said outer tubular housing, and (f) longitudinally spaced discharge orifices in a side of said inner tubular housing with each said discharge orifice in said inner tubular housing being in alignment with an adjacent discharge orifice in said outer tubular housing in position to aim a stream of water ejected therefrom toward the center of said adjacent discharge orifice in said outer tubular housing so that said stream of water is injected into a column of air as said stream of water passes through said adjacent orifice in said outer tubular housing to thereby mix the water and air.

2. Apparatus for making snow as defined in claim 1 in which said inner tubular housing is mounted concentrically within said outer tubular housing.

3. Apparatus for making snow as defined in claim 1 in which each said orifice in said inner tubular housing is smaller than said adjacent orifice in said outer tubular housing so that the stream of water ejected from said orifice in said iner tubular housing is surrounded by air as it reaches said adjacent orifice in said outer tubular housing.

4. Apparatus for making snow as defined in claim 1 in which all of said orifices are aligned in the same direction so that adjacent columns of atomized water discharged from adjacent orifices in said outer tubular housing move in a direction generally parallel to each other.

5. Apparatus for making snow as defined in claim 1 in which the air under pressure ranges from approximately 70 to 120 pounds per square inch.

6. Apparatus for making snow as defined in claim 1 in which the water under pressure ranges from approximately 150 to 650 pounds per square inch.

7. Apparatus for making snow as defined in claim 1 in which at least 10 of said discharge orifices are provided in said outer tubular housing.

8. Apparatus for making snow as defined in claim 1 in which the maximum distance between said discharge orifices in said tubular housing is approximately 12 inches.

9. Apparatus for making snow as defined in claim 1 in which each of said orifices in said inner tubular housing is approximately 3/16ths inch in diameter and each of said orifices in said outer tubualr housing is approximately 5/16ths inch in diameter.

10. Apparatus for making snow as defined in claim 9 in which the distance between said discharge orifices in said tubular housing ranges from 6 inches to 9 inches.

11. A method for making snow comprising:

(a) introducing water under pressure into a closed inner tubular housing mounted within and spaced from a closed outer tubular housing having longitudinally spaced discharge orifices in a side thereof, (b) concomitantly with the introduction of said water introducing air under pressure between said inner tubular housing and said outer tubular housing with said air flowing outwardly in generally parallel columns through said discharge orifices, and (c) discharging said water from said inner tubular housing into the axial center of each column of air flowing outwardly through each said discharge orifice whereby the water and air passing through and discharged from said orifices travel in the same direction and the flow of air through said orifices is retarded to reduce the volume of air per volume of water passing therethrough.

* * * * *